United States Patent [19]

Madsac et al.

[11] Patent Number: 4,531,984

[45] Date of Patent: Jul. 30, 1985

[54] SURFACE HARDENING PROCESS FOR METAL PARTS

[75] Inventors: Michel Madsac, Sceaux; Thierry Hiron, Le Plessis Robinson, both of France

[73] Assignee: L'Air Liquide, Societe Anonyme pour l'Etude et l'Exploitation des Procedes Georges Claude, Paris, France

[21] Appl. No.: 476,369

[22] Filed: Mar. 17, 1983

[30] Foreign Application Priority Data

Mar. 23, 1982 [FR] France ..... 82 04874

[51] Int. Cl.[3] ..... C21D 1/00; C23C 11/14

[52] U.S. Cl. ..... 148/16.6; 148/16; 148/165; 148/20.3

[58] Field of Search ..... 148/16.6, 16, 20.3

[56] References Cited

U.S. PATENT DOCUMENTS

| | | | |
|---|---|---|---|
| 1,793,309 | 2/1931 | Egan | 148/16.6 |
| 4,322,255 | 3/1982 | Kostelitz | 148/16.6 |

FOREIGN PATENT DOCUMENTS

| | | |
|---|---|---|
| 1521172 | 7/1969 | Fed. Rep. of Germany . |
| 711748 | 9/1931 | France . |
| 711749 | 9/1931 | France . |
| 2388896 | 4/1978 | France . |
| 47847 | 6/1966 | German Democratic Rep. . |
| 410904 | 10/1966 | Switzerland . |

OTHER PUBLICATIONS

A. P. Sizov, Ru850,087 *Chem. Abstracts,* 39, 901[8], 1945.

G. Bouttier et al., *Haerterei Technische Mitteilungen,* 35, No. 6, pp. 284–288, Jun. 1980.

*Primary Examiner*—Veronica O'Keefe

*Attorney, Agent, or Firm*—Lee C. Robinson, Jr.

[57] ABSTRACT

In a surface hardening process for metal parts by nitriding or carbonitriding, the parts to be treated are placed in a furnace and maintained at a temperature of between 490° C. and 750° C., in a nitrogen bearing atmosphere, such atmosphere formed by introducing into the furnace a gaseous mixture comprising in particular ammonia and an oxidizing gas for accelerating the catalytic dissociation of ammonia in contact with said parts. The oxidizing gas is nitrous oxide and the gaseous mixture contains about 0.1% to 10% by volume of nitrous oxide. The invention is well suited for the surface hardening of steel parts.

14 Claims, 1 Drawing Figure

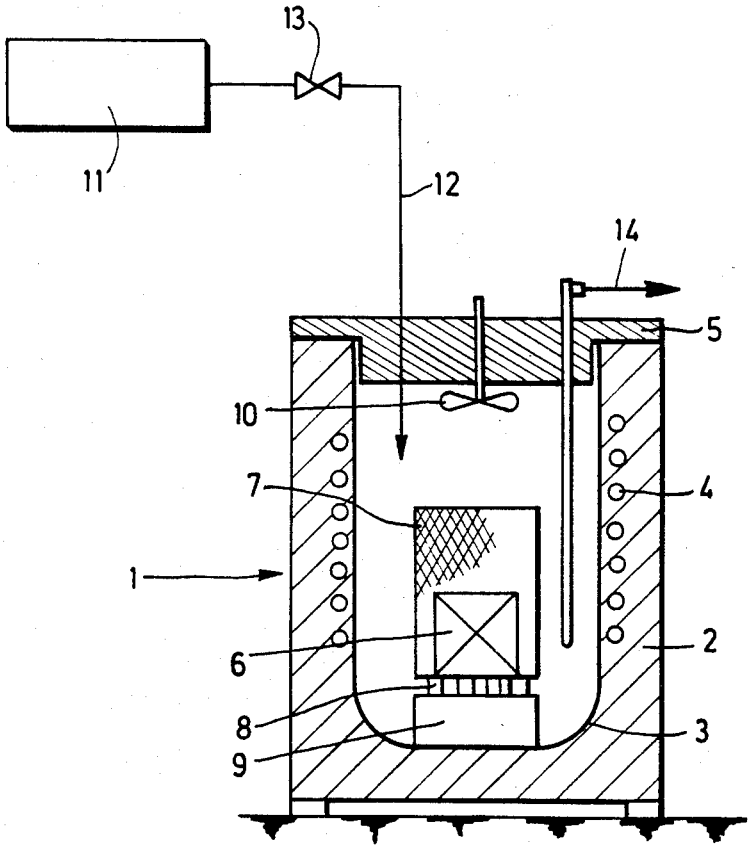
13
11
12
14
5
10
7
4
1
2
6
8
3
9

SURFACE HARDENING PROCESS FOR METAL PARTS

FIELD OF THE INVENTION

The invention concerns a surface hardening process for metal parts, in particular steel parts, by nitriding or carbonitriding.

BACKGROUND OF THE INVENTION

As is well known, nitriding or carbonitriding processes in the gaseous phase are used to improve the fatigue and siezure characteristics and to increase the resistance to wear and corrosion of steels.

These processes involve maintaining the steel parts in an atmosphere containing 50% to 100% of gaseous ammonia at a temperature of 490° C. to 750° C. Parts treated in this way are then cooled by quenching in a gaseous or liquid phase. At the process temperatures used, the gaseous ammonia decomposes partially in contact with the steel parts, and the nitrogen thus released becomes a solid-phase solution and diffuses through a certain depth of the steel. It thus forms a nitrided layer on the surface of the part, consisting of a so-called "combination layer" or "white layer" on a substrate consisting of a so-called "diffusion layer". The structure and composition of these layers is as follows:

The white layer, situated at the extreme surface of the part, consists of of a mixture of $\xi$ nitrides ($Fe_2N$—$Fe_3N$) and $\gamma'$ nitrides ($Fe_4N$).

The diffusion layer, which lies under the white layer, is less hard and more thick than the latter; in this diffusion layer, the nitrogen is in a solid insertion solution and forms nitrides by combining with certain elements existing in the steel.

Nitriding atmospheres used at the present time consist either of gaseous ammonia, or of gaseous ammonia diluted with nitrogen, or of gaseous ammonia, where appropriate diluted with nitrogen, mixed with a compound which can increase the degree of dissociation of the ammonia on contact with the part, and thus the kinetics of nitriding; this compound may, for instance, be an oxidizing compound such as oxygen, carbon dioxide, steam, or a hydrocarbon. In certain processes, a mixture of gaseous ammonia and a carbon-bearing gas is used, for instance, an endothermic gas ($CO$—$H_2$—$CO_2$—$H_2O$—$CH_4$—$N_2$—) or a hydrocarbon; carbonitriding then occurs with the formation of $\xi$ carbonitrides. In all cases of processes used up to the present time, it was preferable to have an initial ammonia concentration in the atmosphere used of at least 50%.

For nitriding processes using ammonia mixed with an oxidizing compound utilised up to the present time, mention may be made specifically of the process described in British Pat. No. 2.049.740. This process consists of holding steel parts at a temperature of 550° C. to 600° C. in a gaseous atmosphere consisting of at least 50% by volume of ammonia, carbon dioxide and nitrogen (e.g. 70% $NH_3$, 7% $CO_2$ and 23% $N_2$), for a duration of 12 to 20 hours.

All these processes enable surface hardening of the parts treated to be obtained, but do however have a number of drawbacks relating to the white layer. This is because:

The white layer develops non-uniformly and thus is of unequal thickness over the surface of the part.

The white layer is fragile and does not adhere well because it consists of an intimate mixture of two compounds $\xi$ ($Fe_2N$—$Fe_3N$) and $\gamma'$ ($Fe_4N$).

The white layer is present in the form of a compact zone covered with a porous zone, which can in some cases have a number of disadvantages. If the process time exceeds a certain period, the compact zone reaches a maximum limiting thickness (20 $\mu$m) and the porous zone alone develops.

The incubation time necessary for nucleation of the nitrides is fairly long and it thus requires a certain time for the white layer to form.

SUMMARY AND OBJECTS OF THE INVENTION

The object of the invention is a surface hardening process for metal parts, particularly steel parts, by nitriding or carbonitriding, which avoids the drawbacks mentioned above.

The process in accordance with the invention consists in placing said parts in a furnace and maintaining them at a temperature between 490° C. and 750° C. in an atmosphere formed by introducing in said furnace a gaseous mixture comprising particularly ammonia and a compound accelerating the catalytic dissociation of ammonia in contact with said parts consisting of an oxidizing gas. This process is characterised in that said oxidizing gas is nitrous oxide, said gaseous mixture containing about 0.1% to 10% by volume of said nitrous oxide.

According to one characteristic of the invention, said gaseous mixture can contain about 10% to 99% by volume of ammonia and at the most 90% of nitrogen by volume.

According to a variation of the invention, said gaseous mixture also contains hydrogen in a concentration of at the most 25% by volume.

According to another characteristic of the invention, in the case of carbonitriding, said gaseous mixture also contains a carbon-bearing gas. This carbon-bearing gas consists, for instance, either of a hydrocarbon, such as methane or propane, in a concentration of no more than 25% by volume, or of methanol in a concentration of no more than 54% by volume, or of a mixture of these two compounds.

Above 400° C., catalytic decomposition of nitrous oxide $N_2O$ is easy, and releases oxygen in its atomic form. This active oxygen stimulates the dissociation of the ammonia in contact with the part being processed, and thus brings about rapid and effective nitriding of said part. Thus, the use of a gaseous mixture containing nitrous oxide in accordance with the invention makes it possible to obtain substantially better results, from a nitriding point of view, than those obtained by using conventional oxidizing compounds such as $O_2$, $CO_2$, or $H_2O$. This is because:

The white layer formed has a constant thickness over the whole surface of the part to be treated.

The white layer consists in general only of the $\xi$ phase ($Fe_2N$—$Fe_3N$), and is thus stronger. If, on occasion, for certain process durations and ammonia contents of the atmosphere used, the $\gamma'$ phase ($Fe_4N$) appears, the latter does not mix with the $\xi$ phase, but is present in the form of a thin zone sandwiched between the $\xi$ zone and the diffusion layer; under these circumstances, the presence of the $\gamma'$ phase does not affect the strength of the nitrided layer.

The porous zone of the white layer is extremely thin and may even be non-existent in the case of short-duration treatments.

The kinetics of the reaction are increased compared with conventional treatments, the incubation time necessary for nitride nucleation being shorter; if required, this enables the initial concentration of the gaseous ammonia mixture to be reduced to 10%, and the duration of the treatment to be shortened, and also enables the flow and renewal rate of the atmosphere in the process furnace to be reduced.

The characteristics and advantages of the invention will appear in the following description, being non exhaustive, of examples of implementing the process according to the invention.

The sole drawing FIGURE illustrates schematically a furnace arranged for the surface treatment of metal parts.

In all the examples described hereafter, treatment is carried out in a "pit" type furnace, represented schematically on the attached FIGURE. This furnace (1) is made of refractory material (2) covered on the inside with a steel liner (3); it is fitted with heating resistors (4) and a cover (5). The steel part to be treated, represented in the form of a block (6), is placed inside the furnace in a basket (7), resting on a grid (8), supported by a base (9) placed on the bottom of the furnace (1); a turbine (10), the function of which is to continuously mix the atmosphere inside the furnace, is located some distance above the basket (7). The constituents of the gaseous treatment mixture are continuously fed into the furnace (1), either from a mixer (11), or separately, by one or more pipes (12) fitted with one or more valves (13), running through the cover (5). This gaseous mixture is evacuated from the furnace, also continuously, via pipe (14); the parts treated are then cooled by quenching in an oil bath (not represented on the FIGURE).

The same treatment has already been performed in a "batch" type furnace with a built-in oil bath and comprising an input/output chamber through which the parts to be treated are brought in, and which is provided with an oil-quenching tank.

Naturally, the furnace is previously flushed out using gaseous nitrogen for any change of atmosphere.

EXAMPLE 1

Parts made of steel grade 35CD4, and parts of nitriding steel grade 40CAD612 are both treated with a gaseous mixture consisting of 40% $NH_3$, 3% $N_2O$ and 57% $N_2$ at a temperature of 570° C.

More precisely, the furnace (1) is heated up previously to a temperature of 570° C. The gaseous mixture (40% $NH_3$-3% $N_2O$-57% $N_2$), coming from mixer (11), is then introduced into the furnace (1) and blown around for a period of time. The part to be treated is then placed in a basket (7) which is put into furnace (1). The gaseous mixture of $NH_3$—$N_2O$—$N_2$ is then introduced continuously into the furnace at a rate of 0.25 $m^3$/hour. The renewal rate of the atmosphere in the furnace is five times per hour.

This treatment is performed on:

First, parts of 35CD4 steel, for two hours, three hours and four hours respectively.

Second, on parts of 40CAD612 steel, for two hours, three hours and four hours respectively.

After quenching the parts treated in this way in an oil bath, measurements are made of the thickness and hardness of the nitrided layers. The results obtained are given in the table below:

| Duration of treatment | Steel | Thickness of the white layer | Thickness of diffusion layer | Thickness of porous zone | Vickers hardness of white layer for 20 g | Depth for which there is a Vickers hardness of 550 HV |
|---|---|---|---|---|---|---|
| 2 hrs | 35CD4 | 19 μm | 350 μm | 0 μm | 1200 HV | 80 μm |
| 2 hrs | 40CAD612 | 10 μm | 250 μm | 0 μm | 1400 HV | 90 μm |
| 3 hrs | 35CD4 | 30 μm | 400 μm | 10 μm | 1100 HV | 130 μm |
| 3 hrs | 40CAD612 | 17 μm | 300 μm | 0 μm | 1450 HV | 150 μμ |
| 4 hrs | 35CD4 | 35 μm | 500 μm | 15 μm | 1140 HV | 150 μm |
| 4 hrs | 40CAD612 | 20 μm | 350 μm | 0 μm | 1500 HV | 170 μm |

EXAMPLE 2

Parts made of grade 35CD4 steel are treated with a gaseous mixture consisting of 40% $NH_3$, 3% $N_2O$, 10% $H_2$ and 37% $N_2$ for three and four hours respectively, under conditions identical to those in example 1 (same temperature, same gaseous mixture flow, same furnace atmosphere renewal rate).

After quenching the parts treated in this way in an oil bath, thickness and hardness measurements are performed on the nitrided layers. The results obtained are given in the table below:

| Duration of treatment | Steel | Thickness of the white layer | Thickness of diffusion layer | Thickness of porous zone | Vickers hardness of white layer for 20 g | Depth for which there is a Vickers hardness of 550 HV |
|---|---|---|---|---|---|---|
| 3 hrs | 35CD4 | 10 μm | 400 μm | 0 μm | 900 HV | 130 μm |
| 4 hrs | 35CD4 | 12 μm | 500 μm | 0 μm | 1100 HV | 150 μm |

EXAMPLE 3

Parts made of grade 35CD4 steel are treated with a gaseous mixture consisting of 40% $NH_3$, 3% $N_2O$, 5% $C_3H_8$ and 52% $N_2$, for four hours, under conditions identical to those in example 1 (temperature, flow, renewal rate).

After quenching the parts treated in this manner in an oil bath, thickness and hardness measurements are carried out on the carbonitrided layers. The results obtained are given in the following table:

| Duration of treatment | Steel | Thickness of the white layer | Thickness of diffusion layer | Thickness of porous zone | Vickers hardness of white layer for 20 g | Depth for which there is a Vickers hardness of 550 HV |
|---|---|---|---|---|---|---|
| 4 hrs | 35CD4 | 33 μm | 450 μm | 13 μm | 1100 HV | 150 μm |

EXAMPLE 4

Parts made of grade 35CD4 steel and other parts made of 40CAD612 grade steel are both treated with a gaseous mixture consisting of 40% $NH_3$, 3% $N_2O$, 11% $CH_3OH$ and 46% $N_2$, for two and a half hours, under conditions identical to those in example 1 (temperature, flow, renewal rate).

After quenching the parts treated in this way in an oil bath, thickness and hardness measurements are made on the carbonitrided layers. The results obtained are given in the table below:

| Duration of treatment | Steel | Thickness of the white layer | Thickness of diffusion layer | Thickness of porous zone | Vickers hardness of white layer for 20 g | Depth for which there is a Vickers hardness of 550 HV |
|---|---|---|---|---|---|---|
| 2½ hrs | 35CD4 | 15 μm | 300 μm | 0 μm | 900 HV | 140 μm |
| 2½ hrs | 40CAD612 | 15 μm | 300 μm | 0 μm | 1050 HV | 170 μm |

For comparison purposes, three nitriding and carbonitriding treatments were carried out using conventional gaseous atmospheres in which the oxidizing compound was carbon dioxide, using identical steel parts and under the same conditions are those used in the examples in the invention described above (temperature: 570° C., flow: 0.25 $m^3$/hour; atmosphere renewal rate in furnace: five times per hour).

Process I (nitriding comparison)

An initial treatment was carried out for three hours with a gaseous mixture consisting of 40% $NH_3$, 10% $CO_2$ and 50% $N_2$, first on grade 35CD4 steel parts, second on 40CAD612 steel parts. Thickness and hardness measurements of the nitrided layers on the parts treated in this way gave the following results:

| Duration of treatment | Steel | Thickness of the white layer | Thickness of diffusion layer | Thickness of porous zone | Vickers hardness of white layer | Depth for which there is a Vickers hardness of 550 HV |
|---|---|---|---|---|---|---|
| 3 hrs | 35CD4 | 5 μm | 400 μm | 0 μm | 710 HV | 60 μm |
| 3 hrs | 40CAD612 | 6 μm | 250 μm | 0 μm | 850 HV | 100 μm |

Process II (carbonitriding comparison)

A second treatment was carried out for four hours with a gaseous mixture consisting of 50% $NH_3$, 5% $CO_2$, 15% $CH_4$ and 30% $N_2$, on grade 35CD4 steel parts. Thickness and hardness measurements of the nitrided layers of the parts treated in this way gave the following results:

| Duration of treatment | Steel | Thickness of the white layer | Thickness of diffusion layer | Thickness of porous zone | Vickers hardness of white layer for 20 g | Depth for which there is a Vickers hardness of 550 HV |
|---|---|---|---|---|---|---|
| 4 hrs | 35CD4 | 22 μm | 100 μm | 10 μm | 840 HV | 60 μm |

Process III (carbonitriding comparison)

A third treatment was carried out for three hours using a gaseous mixture consisting of 40% $NH_3$, 24% $H_2$, 12% CO, 24% $N_2$, 1.7% $CO_2$ and 2% $H_2O$, first on 35CD4 steel parts, second on 40CAD612 steel parts. Thickness and hardness measurements on the nitrided layers of the parts treated in this way give the following results:

| Duration of treatment | Steel | Thickness of the white layer | Thickness of diffusion layer | Thickness of porous zone | Vickers hardness of white layer for 20 g | Depth for which there is a Vickers hardness of 550 HV |
|---|---|---|---|---|---|---|
| 3 hrs | 35CD4 | 6 μm | 50 μm | 0 μm | 340 HV | — |
| 3 hrs | 40CAD612 | 5 μm | 50 μm | 0 μm | 580 HV | 20 μm |

As may be seen, thicker nitrided layers and a much harder white layer are obtained using the process which is the object of the invention than using conventional treatments.

We claim:

1. In a process for the surface treatment of iron-containing metal parts by nitriding, including the steps of placing the parts in a furnace and maintaining the parts in the furnace at a temperature between substantially 490° C. and 750° C. in an atmosphere formed by introducing into said furnace a gaseous mixture comprising ammonia and catalytic gaseous compound means for catalytically accelerating the dissociation of the ammonia in contact with said parts into nitrogen and hydrogen, with the gaseous compound means including an oxidizing gas; the improvement wherein said oxidizing gas is nitrous oxide, and said gaseous mixture contains substantially 0.1% to 10% by volume of said nitrous oxide.

2. Process according to claim 1, wherein said gaseous mixture contains about 10% to 99% by volume of ammonia.

3. Process according to claim 1 or 2, wherein said gaseous mixture contains a significant amount but no more than 90% of nitrogen by volume.

4. Process according to claim 1 or 2, wherein said gaseous mixture contains no more than 25% of hydrogen by volume.

5. Process according to claim 1 or 2 wherein, for additionally carrying out carbonitriding, said gaseous mixture in addition contains a carbonbearing gas.

6. Process according to claim 5, wherein said gaseous mixture contain a significant amount but no more than 25% by volume of a hydrocarbon.

7. Process according to claim 5, wherein said gaseous mixture contains a significant amount but no more than 54% of methanol by volume.

8. Process according to claim 1 or 2, wherein the atmosphere in the furnace is renewed at least two to ten times per hour.

9. Process according to claim 1, wherein said parts are held in said atmosphere for at least one hour.

10. Process according to claim 3, wherein the gaseous mixture contains a significant amount but no more than 25% of hydrogen by volume.

11. Process according to claim 3, wherein for additionally carrying out carbonitriding, said gaseous mixture in addition contains a carbon-bearing gas.

12. Process according to claim 4, wherein for additionally carrying out carbonitriding, said gaseous mixture in addition contains a carbon-bearing gas.

13. Process according to claim 6, wherein said hydrocarbon is selected from the group consisting of methane, propane, and mixtures thereof.

14. Process according to claim 6, wherein said gaseous mixture contains a significant amount but no more than 54% methanol by volume.

* * * * *